US007163134B2

(12) United States Patent
Moeller et al.

(10) Patent No.: US 7,163,134 B2
(45) Date of Patent: Jan. 16, 2007

(54) REPETITIVE CYCLE TOOL LOGIC AND MODE INDICATOR FOR COMBUSTION POWERED FASTENER-DRIVING TOOL

(75) Inventors: Larry M. Moeller, Mundelein, IL (US); Joseph E. Fabin, Elmwood Park, IL (US); James E. Doherty, Barrington, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/028,450

(22) Filed: Jan. 3, 2005

(65) Prior Publication Data

US 2005/0173487 A1 Aug. 11, 2005

Related U.S. Application Data

(60) Provisional application No. 60/543,053, filed on Feb. 9, 2004.

(51) Int. Cl.
*B25C 1/04* (2006.01)

(52) U.S. Cl. ..... 227/8; 227/2; 227/10; 227/130

(58) Field of Classification Search ..... 227/8, 227/10, 130, 2; 123/46 SC
See application file for complete search history.

(56) References Cited

U.S. PATENT DOCUMENTS 4,483,473 A * 11/1984 Wagdy ..... 227/8
4,717,060 A 1/1988 Cotta
4,721,240 A 1/1988 Cotta
5,263,439 A 11/1993 Doherty et al.
5,592,580 A 1/1997 Doherty et al.
5,909,836 A 6/1999 Shkolnikov et al.
6,116,489 A 9/2000 Branston
6,123,241 A 9/2000 Walter et al.
6,145,724 A 11/2000 Shkolnikov et al.
6,715,655 B1 * 4/2004 Taylor et al. ..... 227/8
6,722,550 B1 * 4/2004 Ricordi et al. ..... 123/46 SC
6,783,042 B1 * 8/2004 Kaufer ..... 225/1
6,886,730 B1 * 5/2005 Fujisawa et al. ..... 227/8
6,889,885 B1 * 5/2005 Ohmori ..... 227/10
6,983,871 B1 * 1/2006 Shima et al. ..... 227/8
2005/0173484 A1 * 8/2005 Moeller et al. ..... 227/8
2005/0173485 A1 * 8/2005 Moeller et al. ..... 227/10

* cited by examiner

*Primary Examiner*—John Sipos
*Assistant Examiner*—Michelle Lopez
(74) *Attorney, Agent, or Firm*—Lisa M. Soltis; Mark W. Croll; Greer, Burns & Crain Ltd.

(57) ABSTRACT

A combustion-powered fastener-driving tool includes a combustion-powered power source, a workpiece contact element reciprocable relative to the power source between a rest position and a firing position, a control system operationally associated with the power source, a trigger connected to the control system providing operator interface with the control system. The control system is configured so that an operator may select between a sequential firing mode in which the trigger must be released between firings, and a repetitive cycle mode in which the trigger is continually depressed between firings. The trigger is connected to the control system so that at least one of the frequency and duration of pulling of the trigger converts the operating mode from the sequential mode to the repetitive cycle mode.

13 Claims, 9 Drawing Sheets

REPETITIVE CYCLE TOOL LOGIC AND MODE INDICATOR FOR COMBUSTION POWERED FASTENER-DRIVING TOOL

RELATED APPLICATION

The present application claims priority under 35 USC§ 120 from U.S. Ser. No. 60/543,053 filed Feb. 9, 2004.

BACKGROUND

The present invention relates generally to fastener-driving tools used to drive fasteners into workpieces, and specifically to combustion-powered fastener-driving tools, also referred to as combustion tools.

Combustion-powered tools are known in the art, and are described in U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from Illinois Tool Works of Glenview, Ill.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Combustion-powered tools now offered on the market are sequentially operated tools. The tool must be pressed against the work, collapsing the work or workpiece contact element (WCE) before the trigger is pulled for the tool to fire a nail. This contrasts with pneumatic tools, which can be fired in a repetitive cycle operational format. In other words, the latter tools will fire repeatedly by pressing the tool against the workpiece, if the trigger is held in the depressed mode. These differences manifest themselves in the number of fasteners that can be fired per second for each style tool. The repetitive cycle of a pneumatic tool mode is substantially faster than the sequential fire mode; 4 to 7 fasteners can be fired per second in repetitive cycle as compared to a maximum of 3–4 fasteners per second in sequential mode.

Comparatively, the sequential only cycle for combustion powered tools is limited to a maximum of 2–3 cycles per second.

The distinguishing feature that limits combustion-powered tools to sequential operation is the operator's manual control of the valve sleeve via a lockout mechanism that is linked to the trigger. This mechanism holds the combustion chamber closed until the operator releases the trigger, thus taking into account the operator's relatively slow musculature response time. In other words, the physical release of the trigger consumes enough time of the firing cycle to assure piston return. It is disadvantageous to maintain the chamber closed longer than the minimum time to return the piston, as cooling and purging of the tool is prevented.

Thus, there is a need for a combustion-powered fastener-driving tool which is capable of operating in a repetitive cycle mode. There is also a need for a combustion-powered fastener-driving tool which is selectable between a sequential and repetitive cycle mode.

BRIEF SUMMARY

The above-listed needs are met or exceeded by the present repetitive cycle combustion-powered fastener-driving tool which overcomes the limitations of the current technology. Among other things, the present tool is designed for repeated high-cycle rate firing, and it provides for operator selection of either repetitive cycle or sequential fire.

More specifically, the present combustion-powered fastener-driving tool includes a combustion-powered power source, a workpiece contact element reciprocable relative to the power source between a rest position and a firing position, a control system operationally associated with the power source, a trigger connected to the control system providing operator interface with the control system. The control system is configured so that an operator may select between a sequential firing mode in which the trigger must be released between firings, and a repetitive cycle mode in which the trigger is continually depressed between firings. The trigger is connected to the control system so that at least one of the frequency and duration of pulling of the trigger converts the operating mode from the sequential mode to the repetitive cycle mode.

In another embodiment, a combustion-powered fastener-driving tool includes a combustion-powered power source, a workpiece contact element reciprocable relative to the power source between a rest position and a firing position, a control system operationally associated with the power source, a trigger connected to the control system providing operator interface with the control system, the control system being configured so that an operator may select between a sequential firing mode in which the trigger must be released between firings, and a repetitive cycle mode in which the trigger is continually depressed between firings. A switch is connected to the control system for manually changing between said sequential firing and said repetitive cycle modes.

DETAILED DESCRIPTION

Figure 1:
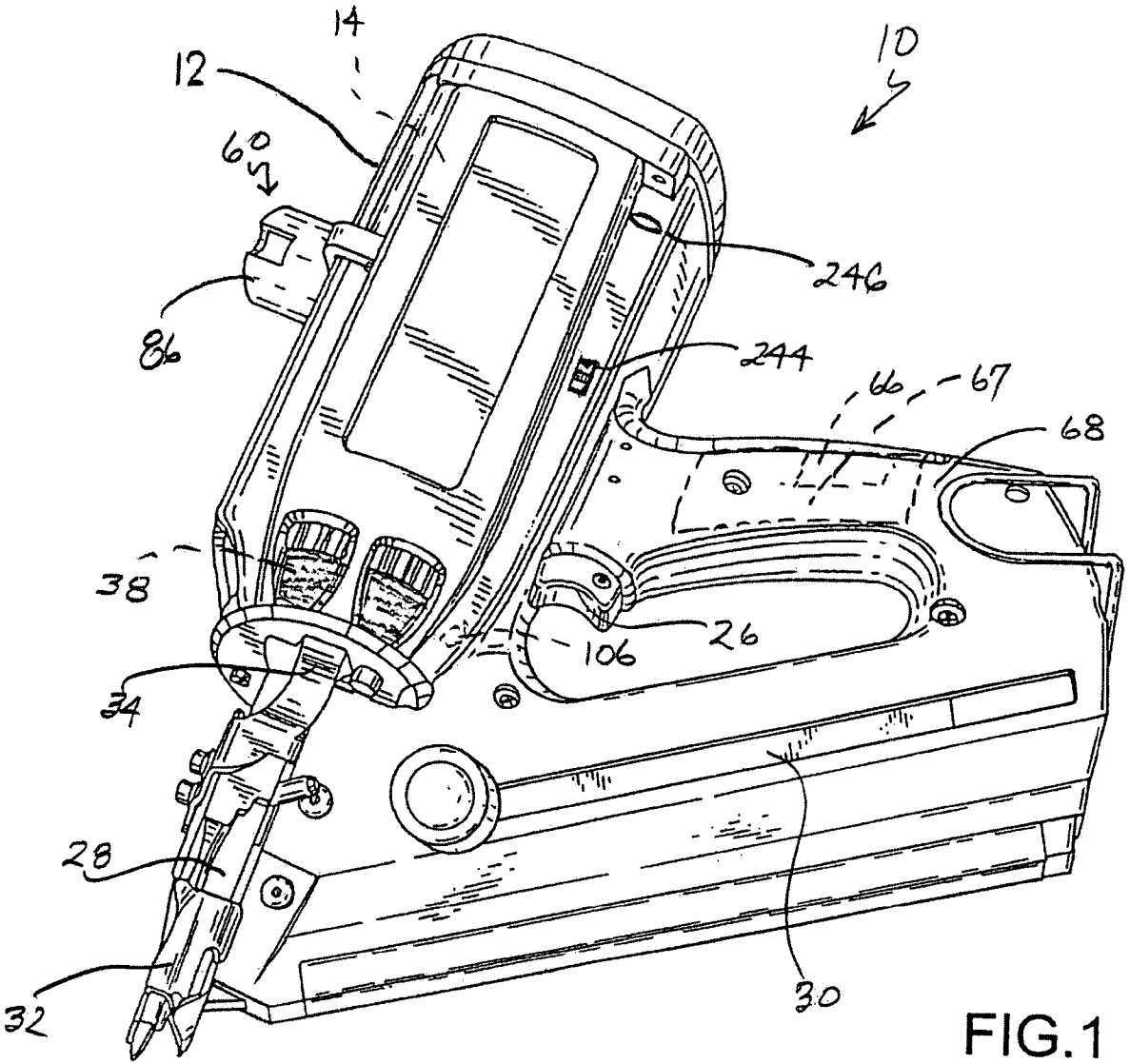
FIG. 1 is a front perspective view of a fastener-driving tool incorporating the present combustion chamber control system.
Figure 2:
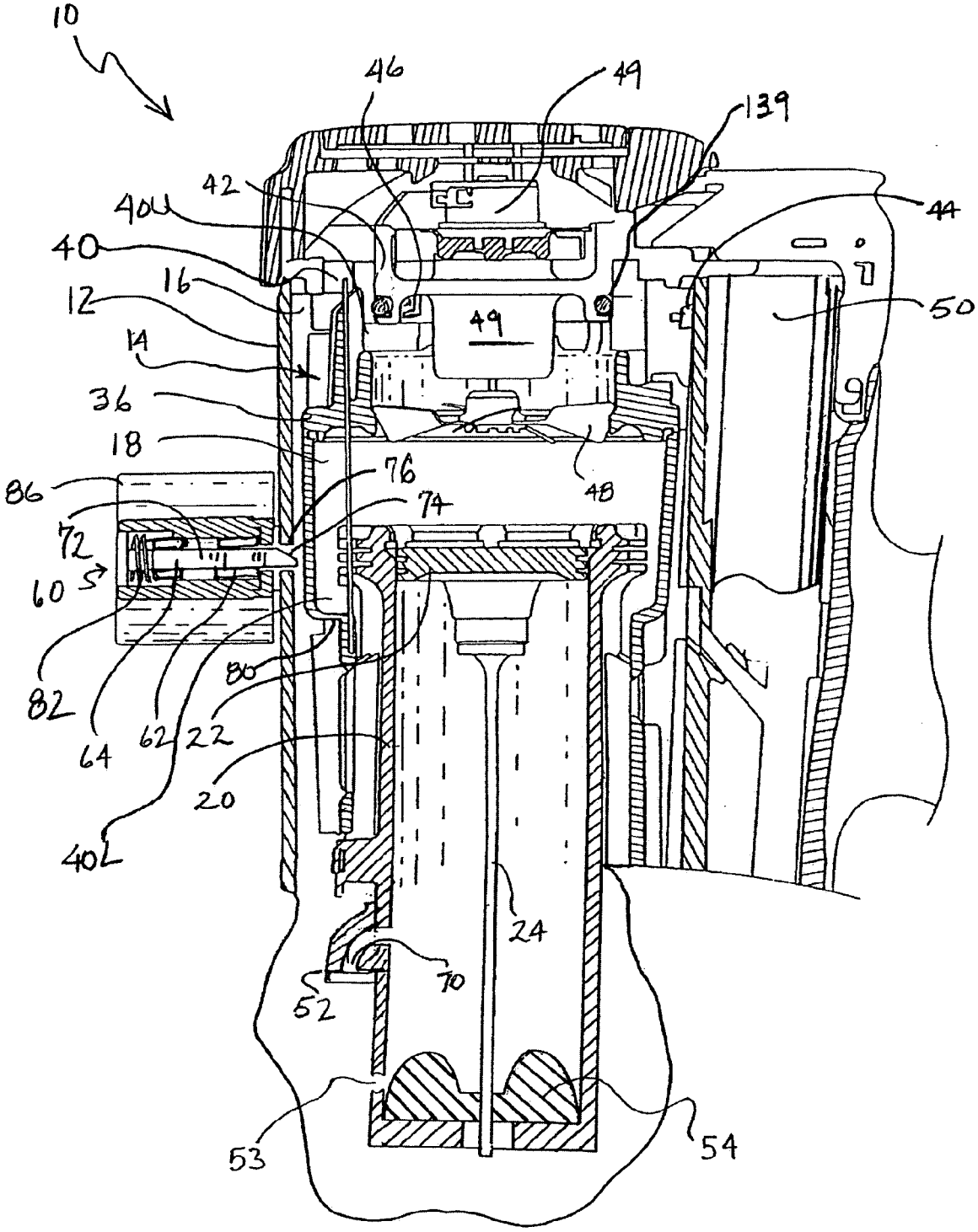
FIG. 2 is a fragmentary vertical cross-section of the tool of FIG. 1 shown in the rest position.
Figure 3:
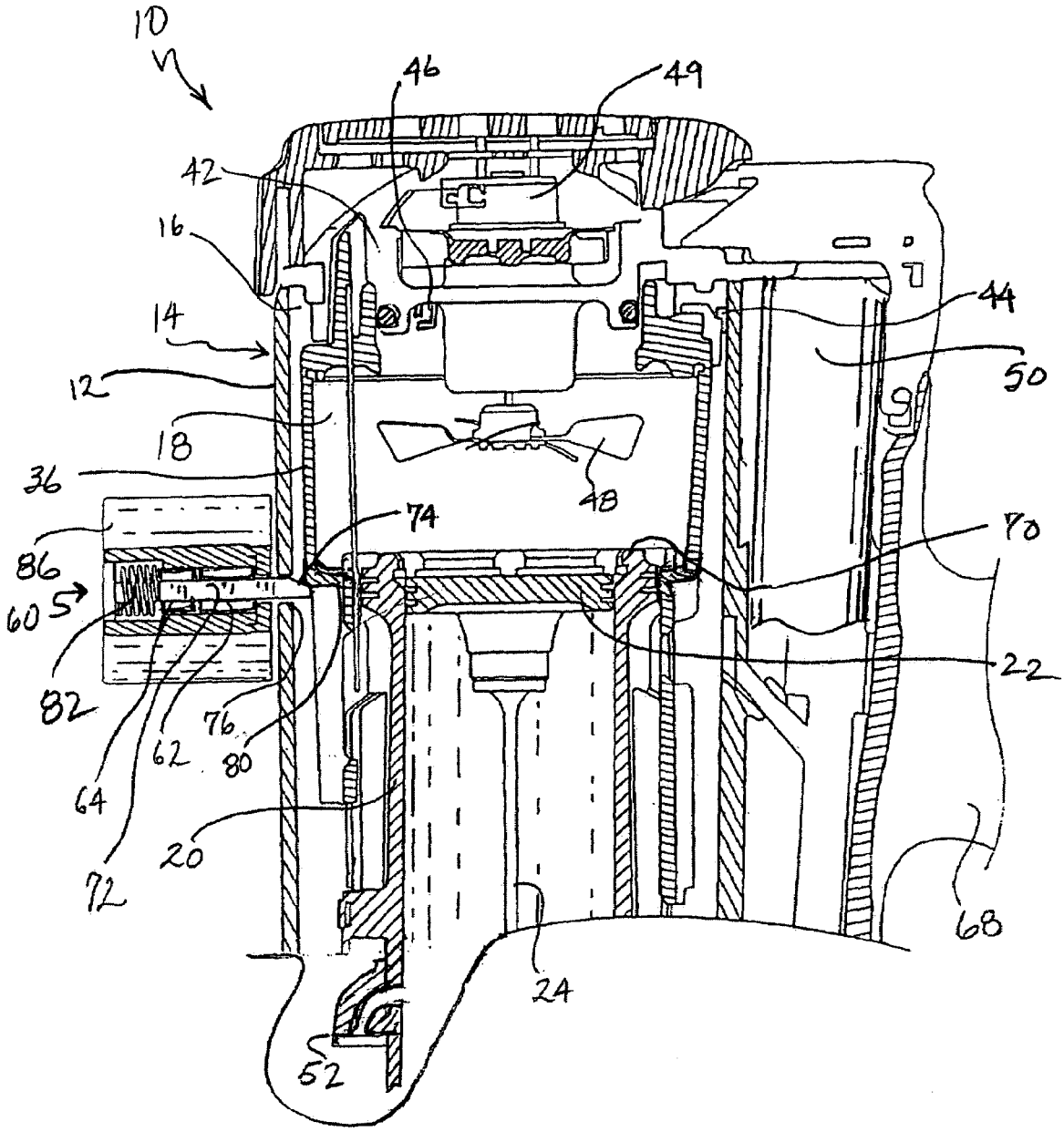
FIG. 3 is a fragmentary vertical cross-section of the tool of FIG. 2 shown in the pre-firing position.

Referring now to FIGS. 1–3, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

The operator induces combustion within combustion chamber 18 in sequential mode through depression of a trigger 26, or in repetitive mode via the chamber or head switch 44, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in proximity to the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a firing position. This movement overcomes the normally downward biased orientation of the workpiece contact element 32 caused by a spring 38 (shown hidden in FIG. 1).

Through the linkage 34, the workpiece contact element 32 is connected to and reciprocally moves with, the valve sleeve 36. In the rest position (FIG. 2), the combustion chamber 18 is not sealed, since there are annular gaps 40, more specifically an upper gap 40U separating the valve sleeve 36 and a cylinder head 42, and a lower gap 40L separating the valve sleeve 36 and the cylinder 20 which accommodates a spark plug 46. In the preferred embodiment of the present tool 10, the cylinder head 42 also is the mounting point for a cooling fan 48 and an associated fan motor 49 powering the cooling fan. The fan and at least a portion of the motor extend into the combustion chamber 18 as is known in the art and described in the patents which have been incorporated by reference above. In the rest position depicted in FIG. 2, the tool 10 is disabled from firing because the valve sleeve 36 is not sealed with the cylinder head 42 or with the cylinder 20, and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gaps 40U and 40L and sealing the combustion chamber 18 until the chamber switch 44 is activated. This operation also induces a measured amount of fuel to be released into the combustion chamber 18 from a fuel canister 50 (shown in fragment).

Upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond the piston displacement (FIG. 2). At the bottom of the piston stroke or the maximum piston travel distance, the piston 22 impacts a resilient bumper 54 as is known in the art. With the piston beyond exhaust check valve 52, high pressure gases vent from cylinder 20 until near atmospheric pressure conditions are obtained and the check valve 52 closes. Due to internal pressure differentials in the cylinder 20, the piston 22 is drawn back to the pre-firing position shown in FIG. 3.

As described above, one of the issues confronting designers of combustion-powered tools of this type is the need for a consistent return of the piston 22 to pre-firing position and improved chamber 18 control prior to the next cycle. This need is especially critical if the tool is to be fired in a repetitive cycle mode, where an ignition occurs each time the workpiece contact element 32 is retracted, and during which time the trigger 26 is continually held in the pulled or squeezed position.

Referring now to FIGS. 2 and 3, to accommodate these design concerns, the present tool 10 preferably incorporates a combustion chamber control device, generally designated 60 and configured for preventing the reciprocation of the valve sleeve 36 from the closed or firing position until the piston 22 returns to the pre-firing position. This holding or locking function of the control device 60 is operational for a specified period of time required for the piston 22 to return to the pre-firing position. Thus, the operator using the tool 10 in a repetitive cycle mode can lift the tool from the workpiece where a fastener was just driven, and begin to reposition the tool for the next firing cycle. Due to the shorter firing cycle times inherent with repetitive cycle operation, the lockout device 60 ensures that the combustion chamber 18 will remain sealed, and the differential gas pressures maintained so that the piston 22 will be returned before premature opening of the chamber 18, which would interrupt piston return. While a preferred embodiment of a lockout control device 60 is described below, it will be understood that other types of lockout control devices, whether electronic or mechanical, may be provided for delaying the opening of the combustion chamber 18 for a specified period of time considered adequate for consistent piston return. Such lockout or delay devices are needed for tools capable of repetitive cycle operation where the operator has the potential for defeating conventional piston return cycle mechanisms by removing the tool from the workpiece between combustion firings before the piston has a chance to return to the pre-firing position.

More specifically, and referring to FIG. 3, the combustion chamber control device 60 includes an electromagnet 62 configured for engaging a latch 64 which transversely reciprocates relative to the valve sleeve 36 for preventing the movement of the valve sleeve for a specified amount of time. This time period is controlled by a control program 66 (FIGS. 4A–6C) embodied in a central processing unit or control module 67 (shown hidden), typically housed in a handle portion 68 (FIG. 1) of the housing 12. The control program 66, the CPU 67 and the associated wiring and components is collectively referred to as the control system. While other orientations are contemplated, in the preferred embodiment, the electromagnet 62 is coupled with the sliding latch 64 such that the axis of the electromagnet's coil and the latch is transverse to the driving motion of the tool 10. The device 60 is mounted in operational relationship to an upper portion 70 of the cylinder 20 so that sliding legs or cams 72 of the latch 64 having angled ends 74 pass through apertures 76 in a mounting bracket 78 and the housing 16 to engage a recess 80 in the valve sleeve 36 once it has reached the firing position. The latch 64 is biased to the locked position by a spring 82 and is retained by the electromagnet 62 for a specified time interval.

For the proper operation of the combustion chamber control device 60, the control program 66 must be configured so that the electromagnet 62 is energized for the proper period of time to allow the piston 22 to return to the pre-firing position subsequent to firing. As the operator pushes the tool 10 against the workpiece and the combustion chamber 18 is sealed, the latch 64 is biased against the wear plate 83, extending the legs 72. More specifically, when the control program 66, triggered by an operational sequence of switches (not shown) indicates that conditions are satisfactory to deliver a spark to the combustion chamber 18, the electromagnet 62 is energized for approximately 100 msec. During this event, the latch 64 is held in position, thereby preventing the chamber 18 from opening. The period of time of energization of the electromagnet 62 would be such that enough dwell is provided to satisfy all operating conditions for full piston return. This period may vary to suit the application.

The control program 66 is configured so that once the piston 22 has returned to pre-firing position, the electromagnet 62 is deenergized, reducing the transversely directed force on the legs 72. As is known, the valve sleeve 36 must be moved downwardly to open the chamber 18 for exchanging gases in the combustion chamber and preparing for the next combustion. While in FIGS. 1–3 the electromagnet 62 is shown on a front of the housing 12, it is contemplated that it can be located elsewhere on the tool 10 as desired.

Another feature of the present tool 10 is that the duration of the holding time of the electromagnet 62 can be related to, and controlled by the temperature of the power source engine temperature with the use of at least one temperature-sensing device 106, such as at least one thermistor, which is preferably located at a lower end of the cylinder 20 near the spring 38 (shown hidden in FIG. 1). Other locations on the tool 10, and other types of temperature-sensing devices are contemplated depending on the application. At elevated tool body temperatures, vacuum-induced piston return is slower and the combustion chamber 18 must be maintained closed longer for full piston return. Inversely, at lower tool body temperatures, the piston return is faster and the required chamber closed time is less.

Referring now to FIGS. 4A–6, the present tool 10 preferably includes a feature that allows an operator to switch the tool between sequential-fire and repetitive cycle modes. This is implemented using a control program or system 120 that can be separated or integrated into the control program 66 that controls and monitors the functions of the tool 10. In the preferred embodiment, and specifically referring to FIG. 4A, the tool 10 incorporating the repetitive cycle option will work as follows: the tool will be default set to operate in sequential-fire mode and operate as is commonly known in the art in view of the patents incorporated by reference herein.

Figure 4A:
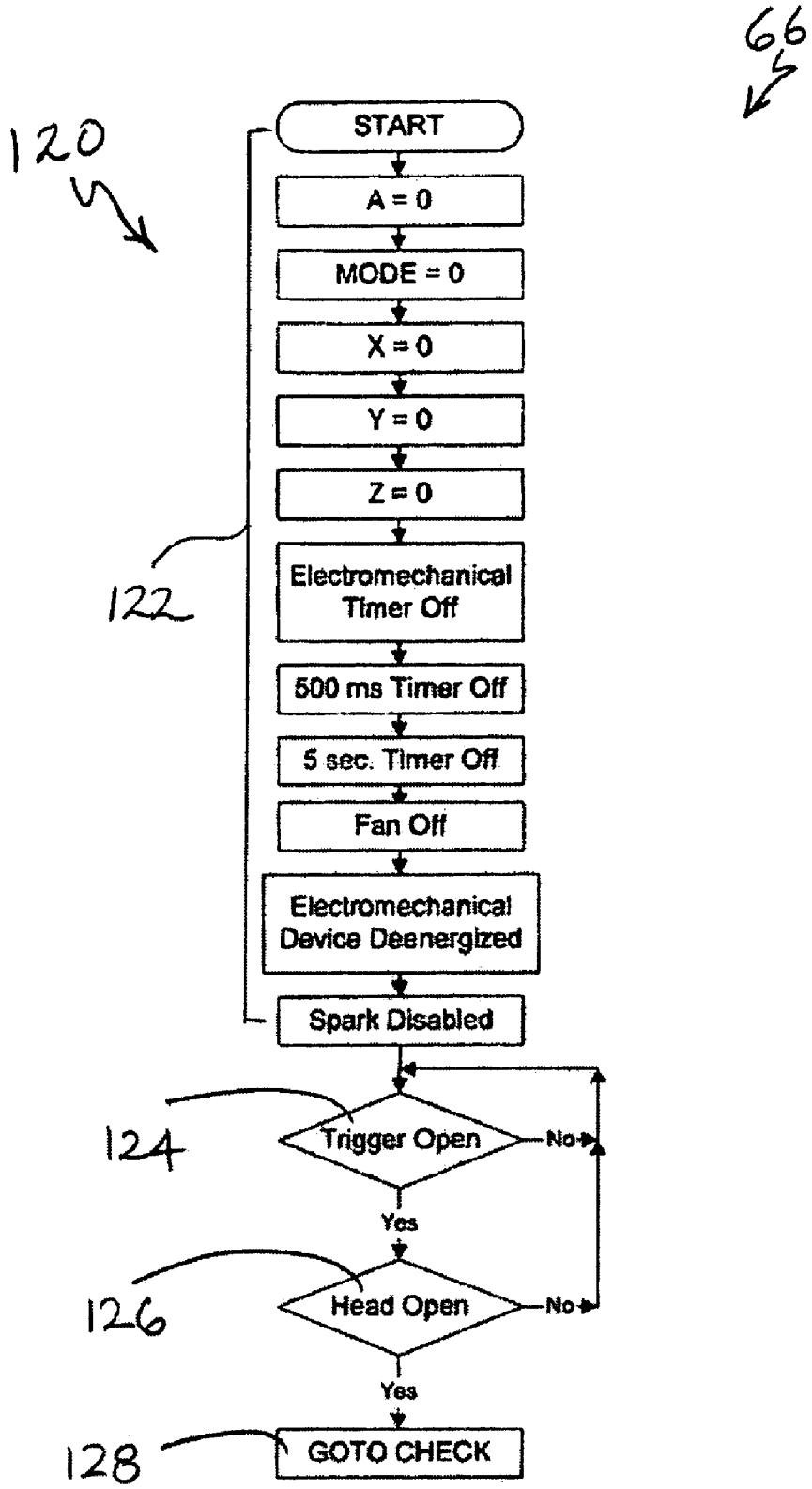
FIGS. 4A–C; 5A–C and 6 are an operational flowchart illustrating the present control program which is user-selectable between sequential and repetitive cycle modes.

The operational cycle begins at the START position 122 with the valve sleeve 36 and the workpiece contact element in the rest position, and the trigger 26 released. As shown in FIG. 4A, in the START position 122 the parameters A, MODE, X, Y, Z are all at 0, an electromechanical lockout device timer, a 500 ms timer, a 5 second timer and the fan 48 are off, the control device 60 is deenergized and the spark controlled by the CPU 67 is deenergized. For the purposes of this application, in the flow charts, "0" is the equivalent to "no" and "≧1" is the equivalent to "yes". Also, the parameters X, Y and Z relate to parameters based on tool conditions which are inputted to the CPU 67. To switch the tool 10 into a firing mode (either sequential or repetitive cycle), the program 120 first checks to see if the trigger 26 is open, at point 124. If the trigger 26 is open or not pulled, next the combustion chamber switch 44, referred to as the "head" in the diagrams and the following discussion, is checked at point 126 to see if the combustion chamber 18 is closed. If the head 44 is closed, upon start of the operational cycle, no action will occur until valve sleeve 36 is in the rest position. However, if the head 44 is open, the program 120 goes to a CHECK subroutine at 128. For simplification, it can be assumed that the combustion chamber 18 is sealed when the head 44 is closed.

Figure 4B:
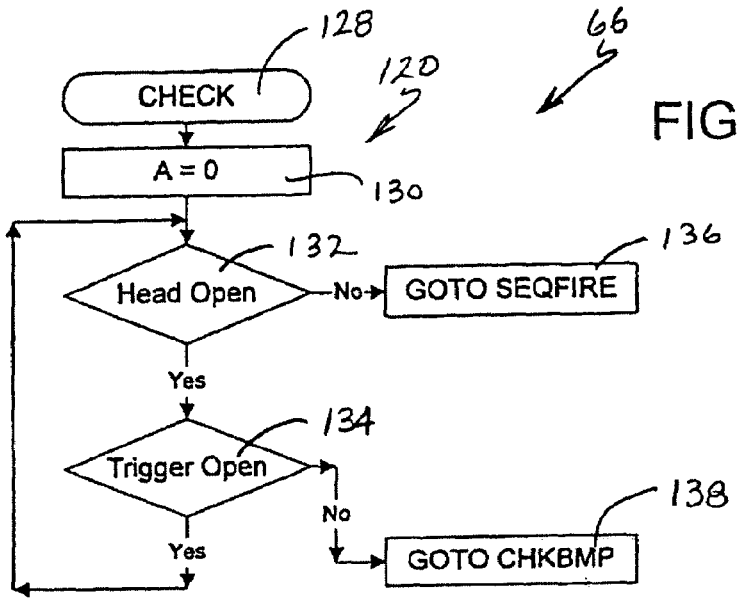
Figure 5A:
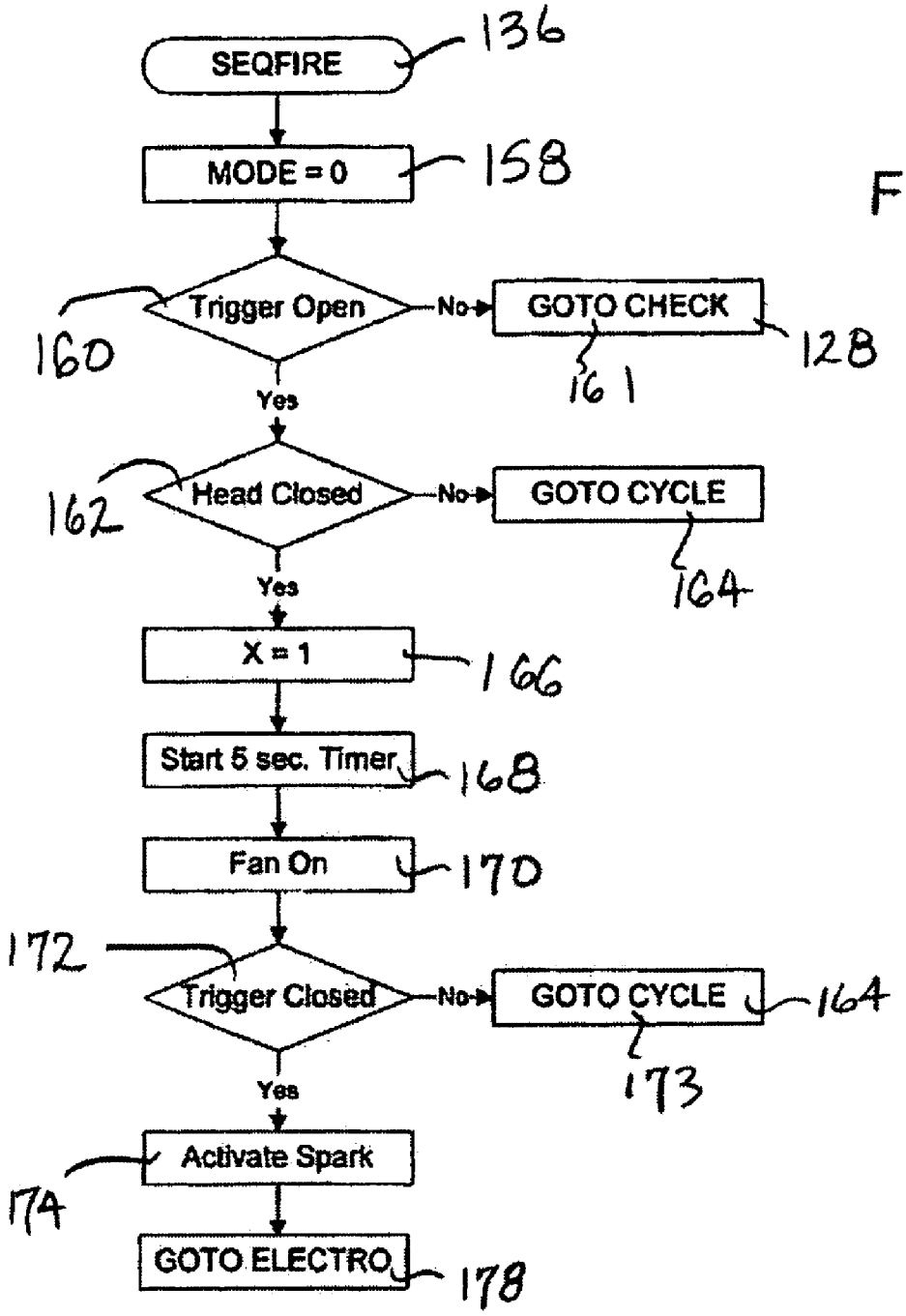

Referring now to FIG. 4B, in the CHECK subroutine 128, the parameter A is still 0 at 130. If the head 44 is open at 132, the trigger 26 is checked at 134. If the head 44 is closed, the program 120 goes to SEQFIRE at 136 (FIG. 5A discussed later). If the trigger 26 is open at 134, the subroutine 128 loops back to head 44 open at 132 and the program cycles to monitor switch activity. If the head 44 is open at 132 and the trigger 26 is closed or pulled, the program 120 goes to CHKBUMP at 138.

Figure 4C:
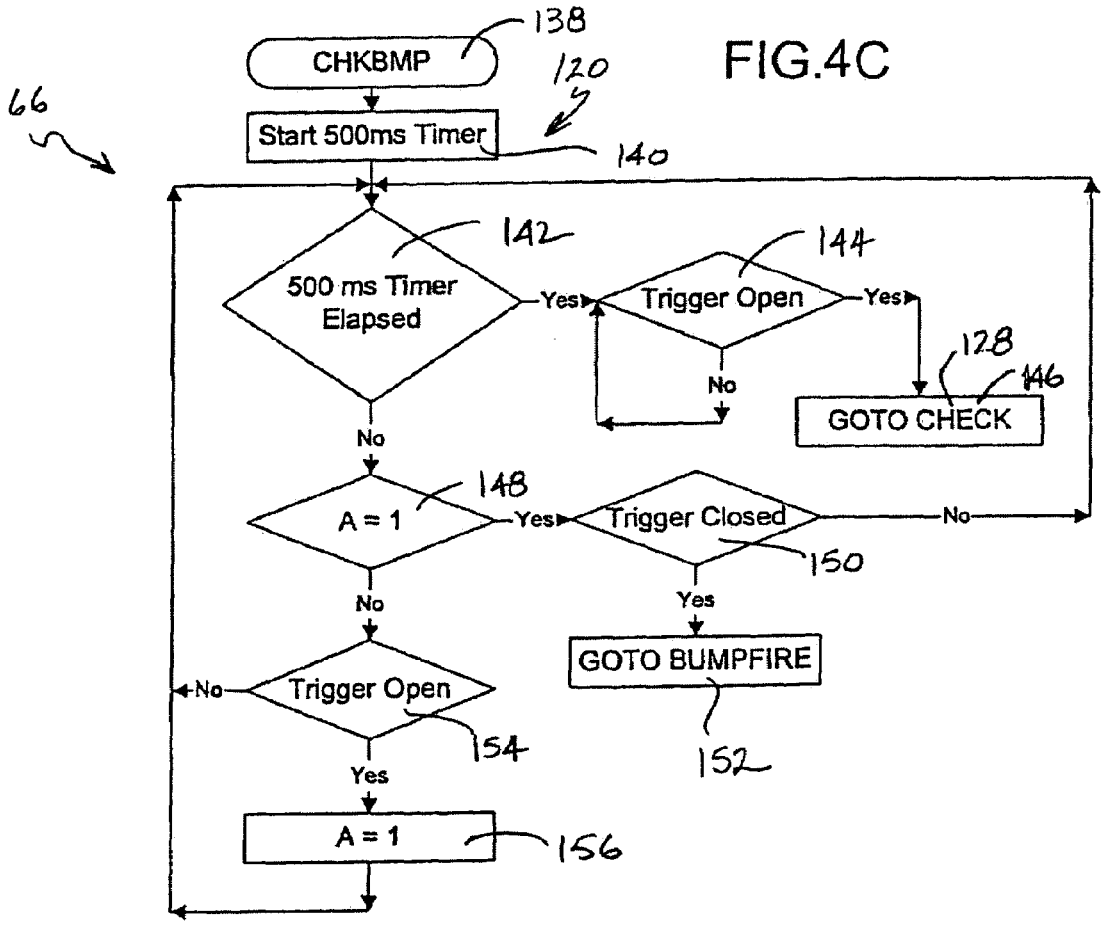

Referring now to FIG. 4C, at CHKBUMP 138, this subroutine represents the position of the trigger 26 (pulled or not), since it is important that the trigger 26 remain depressed or pulled to maintain the repetitive cycle mode once that mode has been selected. In FIG. 4C, the trigger 26 needs to be fully closed (from FIG. 4B no. 134), fully released, and fully closed again all within 500 ms to put the tool 10 into the repetitive cycle mode.

Following are the preferred detailed steps for placing the tool in the repetitive cycle mode. First, the trigger 26 is fully closed (from FIG. 4B no. 134). A 500 ms timer is started at 140. The 500 ms has not elapsed at 142, A does not equal 1 at 148, and the trigger 26 is not open at 154 (the trigger is still closed from FIG. 4B at 134). The 500 ms timer is rechecked at 142. The 500 ms still has not elapsed. A does not yet equal 1 at 148.

At this point the trigger 26 is released. A is now set to 1 at 156. The 500 ms timer is rechecked at 142. The 500 ms still has not elapsed. Because A now equals 1 at 148, the trigger is checked at 150. Next, the trigger 26 is closed. The tool is now set to the repetitive cycle mode at 152. If the trigger 26 is not fully closed (from FIG. 4B no. 134), fully released, and fully closed again all within 500 ms, the sequence of events ends up at GOTO CHECK at 146.

Referring now to FIG. 5A, the SEQFIRE or sequence fire subroutine 136 begins with the MODE parameter at 0 at 158. Again, the status of the trigger 26 is rechecked at 160. If closed, the program 120 goes to the subroutine CHECK 128 as 161. Next, the status of the head 44 is checked at 162. If open (acceptable for the sequential mode), the program 120 goes to the CYCLE subroutine at 164 (discussed in detail in relation to FIG. 5B). If the head 44 is closed, the parameter X is set to 1 at 166, a 5 second timer is activated at 168 and the fan 48 is energized at 170. Again, if the trigger 26, checked at 172 is open, the CYCLE subroutine 164 is followed at 173. If the trigger 26 is closed, the CPU 67 is signaled to energize a spark through the spark plug 46 at 174, thus initiating combustion. Then the ELECTRO subroutine is activated at 178 (discussed in detail regarding FIG. 5C).

Figure 5B:
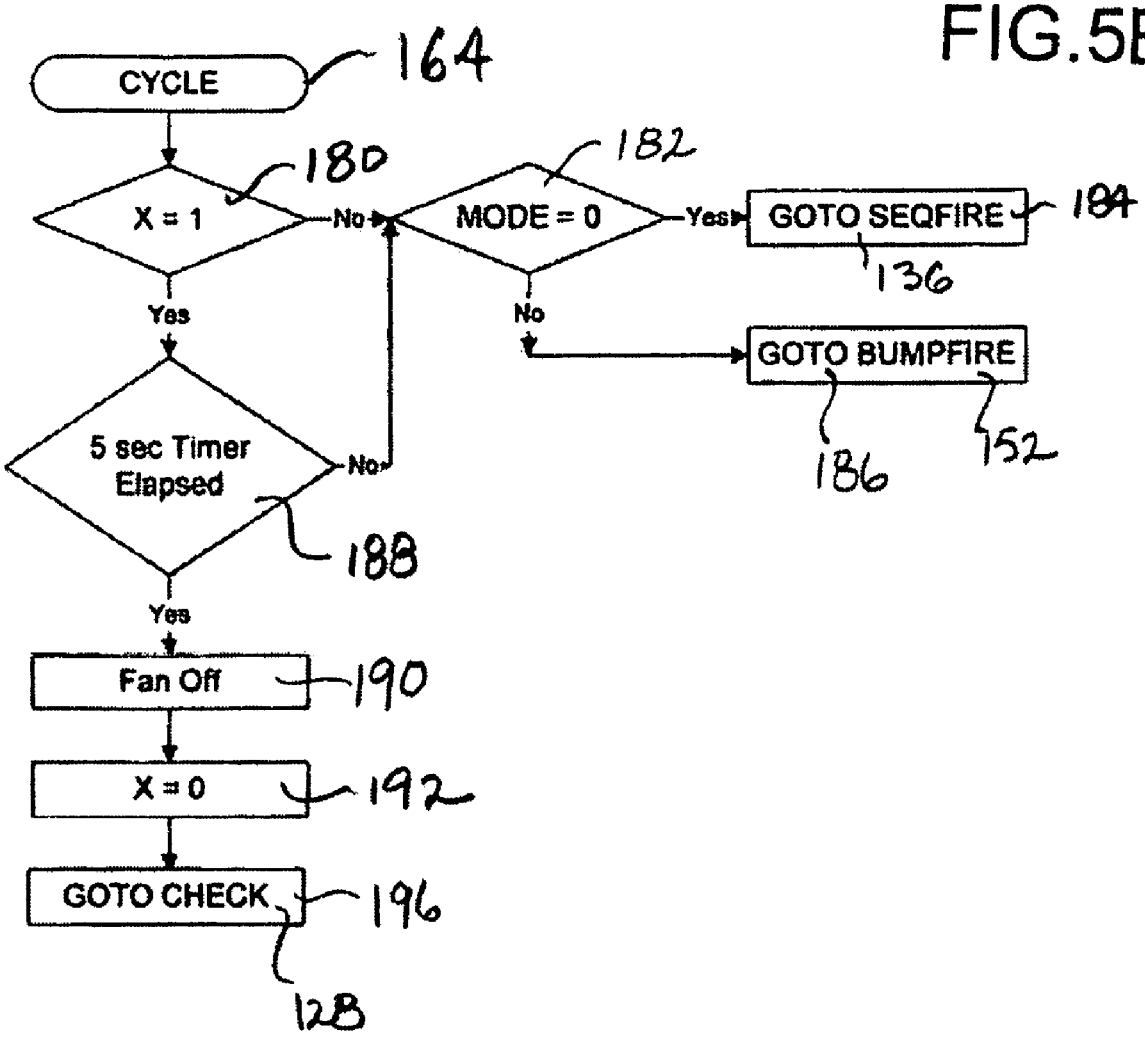

FIG. 5B depicts the CYCLE subroutine 164. Initially, in this subroutine the X parameter=1 at 180, which from SEQFIRE at 136 indicates the trigger 26 is open and the head 44 is closed. If X does not equal 1, the program 120 checks to see whether MODE=0 at 182, and the operating mode is determined. If affirmative, the SEQFIRE subroutine 136 is activated at 184. If negative, the BUMPFIRE subroutine 152 is activated at 186. Returning to step 180, if X=1, and 5 seconds has elapsed at 188 indicating a lack of ignition, the fan 48 is turned off at 190, and X is reset to 0 at 192. Next, the CHECK subroutine 128 is activated at 196. If at step 188 the timer has not elapsed, the program checks Mode=0 at 182, and the operating mode is determined.

Figure 5C:
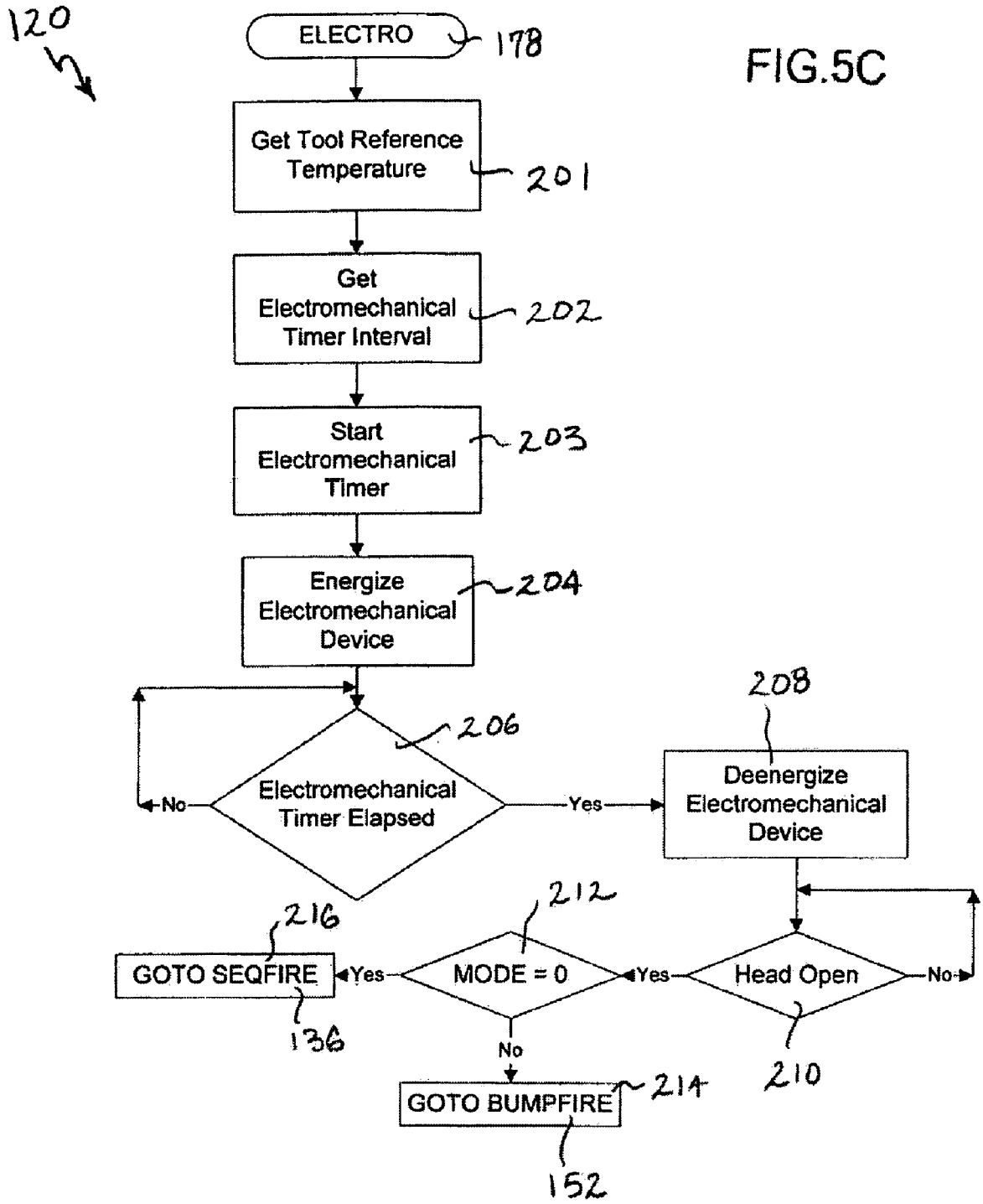

Referring now to FIG. 5C, depicting the ELECTRO subroutine 178, this sequence activates the control device 60. This description includes the optional feature of energizing the electromagnet 62 as a function of tool temperature. First, the program 120 obtains the tool reference temperature from the temperature sensor 106 at 201. Next, at step 202, through the use of a "look-up" table, the program determines a desired time interval for energizing the electromagnet 62. As described above, at higher tool temperatures, longer electromagnet energization periods are needed to ensure piston return to PRE-FIRING. Following that, at step 203, an electromechanical timer is initialized. Next, the electromagnet 62 is energized at 204. As described above, the energization lasts a preset time designed to allow for return of the piston 22 to PRE-FIRING. The duration of the timer is checked at 206. If the preset time has not expired, the system loops at that point. Once it elapses, the electromagnet is deenergized at 208. The program 120 then proceeds when the head 44 is open at 210 and then checks whether MODE equals 0 at 212. If MODE is not 0 then the BUMPFIRE subroutine 152 is activated at 214. If MODE is 0, then the program 120 activates the SEQFIRE subroutine 136 at 216.

Figure 6:
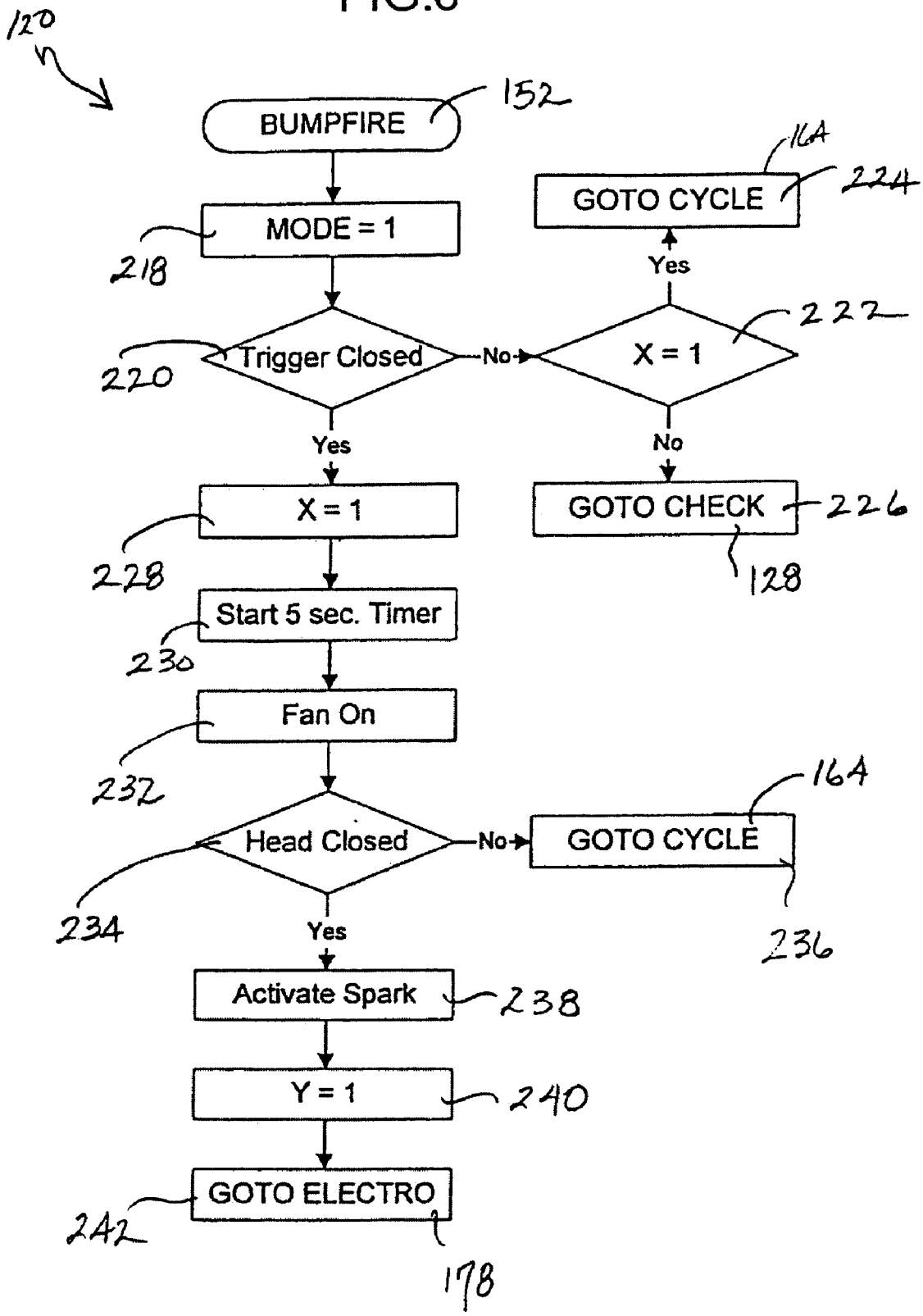

Referring now to FIG. 6, the BUMPFIRE subroutine 152 is shown and then makes MODE equal 1 at 218. The system 120 checks to see whether the trigger 26 is closed at 220. If it is not, then a determination is made whether parameter X equals 1 at 222. If so, then the CYCLE subroutine 164 is activated at 224, and if not, the CHECK subroutine 128 is activated at 226. If the trigger 26 is closed, then parameter X is set to 1 at 228, the 5 second timer is initialized at 230 and the fan 48 is turned on at 232. At that point, the head 44 is checked at 234 if the head 44 is open. If not, the CYCLE subroutine 164 is activated at 236. With the head 44 closed, combustion can occur and the spark is activated at 238, the Y parameter is set to 1 at 240 and the ELECTRO subroutine 178 is initiated at 242 to activate the lockout mechanism 60.

Referring now to FIG. 1, in addition to the program 120, the tool 10 is optionally provided with a manual switch 244 connected to the control system for manually changing between the sequential firing and repetitive cycle modes. The switch 244 is shown disposed on the housing 12, but the specific location on the housing may vary to suit the application. In the preferred version of this embodiment, the switch 244 is connected to the CPU 67 and more specifically to the control program 66 and a portion of the program 120. In functional terms, the switch 244 selects between SEQFIRE 136 (FIG. 5A) and BUMPFIRE 152 (FIG 6), bypassing the CHECK subroutine 128. A visual or audible indicator 246 may be provided to provide notice to the user as to the mode in which the tool 10 is presently operating. It is contemplated that when the switch 244 is provided, the tool 10 would include other features described above, including the temperature sensor 106.

It will be seen that the above-described program 120 allows for repetitive cycle firing or sequential firing, and the respective operating techniques are determined mainly from the sequence of trigger position (open or closed) and cylinder head switch/combustion chamber condition (open or closed). The control system including the program 120 is connected to the trigger 26 so that at least one of the frequency and duration of pulling of the trigger determines whether the tool 10 is in the sequential mode or the repetitive cycle mode.

Further, as described above, the control system 120 is configured so that the trigger 26 is pulled sequentially to initiate the repetitive cycle mode, and the sequential pulls are preferably performed while the workpiece contact element 32 is in a rest position (best seen in FIG. 1). Upon selection to the repetitive cycle mode, upon the depression of the tool 10 against the workpiece so that the workpiece contact element 32 moves to the firing position, the tool fires, and upon firing, will fire again repeatedly each time the workpiece contact element 32 moves to the firing position until one of the trigger 26 is released and a preset time period expires. Upon the achievement of the release of the trigger 26 or expiration of the preset time period, the tool reverts to the sequential firing mode.

In addition, upon at least one initial firing in the sequential mode, the trigger 26 is held by the operator and the tool 10 converts to the repetitive cycle mode, and is firable upon the workpiece contact element 32 achieving the firing position. Basically, in the sequence fire mode, the closing of the trigger 26 initiates firing/combustion. In the repetitive cycle mode, with the trigger 26 continually depressed by the user, the closing of the chamber switch 44 initiates firing/combustion.

In addition, the temperature of the tool 10 is monitored through the temperature sensing device 106, which provides data to the program 120 for adjusting tool operation, such as the delay provided by the combustion chamber control device 60. The program 120 also features an internal timer configured so that, regardless of the mode being employed (sequential or repetitive cycle), after a specified period of time of no ignition, the tool 10 will revert to the default sequential mode, and will eventually return to the rest or start position 122.

While a particular embodiment of the present repetitive cycle tool logic and mode indicator for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source;

a workpiece contact element reciprocable relative to said power source between a rest position and a firing position;

a control system operationally associated with said power source;

a trigger connected to said control system providing operator interface with said control system;

said control system being configured so that an operator may select between a sequential firing mode in which the trigger must be released between firings, and a repetitive cycle mode in which the trigger is continually depressed between firings;

said trigger is connected to said control system so that a frequency and duration of pulling of said trigger converts an operating mode from said sequential mode to said repetitive cycle mode;

wherein said conversion of said sequential firing mode to said repetitive cycle mode is achieved by pulling, fully releasing and pulling said trigger within a designated time period.

2. The tool of claim 1 wherein said control system is configured so that said sequential pulls are performed while said workpiece contact element is in said rest position.

3. The tool of claim 1 wherein said control system is configured so that said trigger needs to be fully closed, fully released, and fully closed again all within 500 ms to put said tool into said repetitive cycle mode.

4. The tool of claim 1 wherein said control system is configured so that upon said selection to said repetitive cycle mode, upon the depression of said tool against the workpiece so that said workpiece contact element moves to said firing position, said tool fires, and upon said firing, will fire again repeatedly each time said workpiece contact element moves to said firing position until one of said trigger is released or a preset time period expires.

5. The tool of claim 4 wherein said control system is configured so that upon the achievement of said release of said trigger or expiration of said preset time period, said tool reverts to said sequential firing mode.

6. The tool of claim 1 wherein said control system is configured so that upon at least one initial firing in said sequential mode, said trigger is held by the operator and said tool converts to said repetitive cycle mode, and is firable upon said workpiece contact element achieving said firing position and closing a head switch.

7. The tool of claim 6 wherein said control system is configured so that upon selection to said repetitive cycle mode, the tool will fire again repeatedly each time said workpiece contact element moves to said firing position until one of said trigger is released and a preset time period expires.

8. The tool of claim 7 wherein said control system is configured so that upon the achievement of said release of said trigger or expiration of said preset time period, said tool reverts to said sequential firing mode.

9. The tool of claim 1 further including an indicator connected to said control system for indicating to the operator whether the tool is in the repetitive cycle mode or the sequential mode.

10. The tool of claim 1 further including a combustion chamber control device configured for delaying the opening of a valve sleeve connected to said workpiece contact element from said firing position until a piston in said power source returns to a pre-firing position.

11. The tool of claim 10 further including at least one temperature sensing device connected to said control system which adjusts a period of energization of said combustion chamber control device as a function of the temperature of the power source.

12. A combustion-powered fastener-driving tool, comprising:

a combustion-powered power source;

a workpiece contact element reciprocable relative to said power source between a rest position and a firing position;

a control system operationally associated with said power source;

a trigger connected to said control system providing operator interface with said control system;

said control system being configured so that an operator may select between a sequential firing mode in which the trigger must be released between firings, and a repetitive cycle mode in which the trigger is continually depressed between firings;

said trigger is connected to said control system so that at least one of a frequency and duration of pulling of said trigger converts the operating mode from said sequential mode to said repetitive cycle mode;

a combustion chamber control device configured for delaying the opening of a valve sleeve connected to said workpiece contact element from said firing position until a piston in said power source returns to a pre-firing position; and at least one temperature sensing device connected to said control system which adjusts a period of energization of said combustion chamber control device as a function of the temperature of the power source; wherein said conversion of said sequential firing mode to said repetitive cycle mode is achieved by pulling, fully releasing and pulling said trigger within a designated time period.

13. The tool of claim 12 wherein said control system is configured such that said conversion of said sequential mode to said repetitive cycle mode is performed while said workpiece contact element is in said rest position.

* * * * *